United States Patent [19]

Voronoff

[11] 3,984,838

[45] Oct. 5, 1976

[54] ELECTRICALLY SMALL, DOUBLE LOOP LOW BACKLOBE ANTENNA

[75] Inventor: George N. Voronoff, San Francisco, Calif.

[73] Assignee: Textron, Inc., Belmont, Calif.

[22] Filed: May 27, 1975

[21] Appl. No.: 580,950

[52] U.S. Cl. ..... 343/739; 343/742; 343/845

[51] Int. Cl.[2] ..... H01Q 1/38; H01Q 7/00

[58] Field of Search ..... 343/708, 739, 845, 846, 343/847, 742

[56] References Cited

UNITED STATES PATENTS

| | | | |
|---|---|---|---|
| 2,894,124 | 7/1959 | Himmel et al. | 343/739 |
| 3,184,746 | 5/1965 | Chatelain | 343/847 |
| 3,268,896 | 8/1966 | Spitz | 343/708 |
| 3,808,600 | 4/1974 | Bourdier | 343/847 |
| 3,906,507 | 9/1975 | Allen | 343/846 |

*Primary Examiner*—Eli Lieberman
*Attorney, Agent, or Firm*—Gregg, Hendricson, Caplan & Becker

[57] ABSTRACT

An electrically small, directive, low backlobe broadband antenna is described. The antenna comprises a pair of radiators. Each of the radiators comprises a pair of orthogonally oriented stripline sections carried on a thin substrate. In one embodiment the radiators are carried on separate substrates placed side by side with a small separation. In another embodiment, the radiators are carried on opposite sides of the same substrate. In each of the embodiments, the radiators are mounted adjacent to a ground plane. A first one of the orthogonal sections is spaced from and extends parallel to the ground plane. The second of the orthogonal sections extends from the first section to the ground plane and is adapted at that point for coupling to the center conductor of a coaxial cable. Means are also provided for coupling the outer conductor or shield of the cable to the ground plane. A resistor is further provided coupled between the ground plane and the free end of each of the first sections of the radiators.

15 Claims, 6 Drawing Figures

| RADIATOR TYPE | H/λ | h/λ | L/λ | ℓ/λ | W/λ | LOAD RESISTOR $R_L$ (OHMS) |
|---|---|---|---|---|---|---|
| TALL ELEMENT (11) | 0.074 | 0.058 | 0.103 | 0.087 | 0.032 | 150 |
| SHORT ELEMENT (12) | 0.032 | 0.027 | 0.111 | 0.106 | 0.011 | 180 |

ELECTRICALLY SMALL, DOUBLE LOOP LOW BACKLOBE ANTENNA

BACKGROUND OF INVENTION

The present invention is related to antennas in general and in particular to a broad-band, electrically small radiator of the end-loaded filament antenna type that exhibits negligible backlobe, a useful gain and an improved directivity. In addition, the antenna (less its feed network) will occupy approximately the same volume as the present configurations.

Both of the above properties (low backlobe and the improved directivity), by themselves, constitute an improvement in the state of the art. More specifically, they result in higher accuracies when used in certain types of modern direction-finding (DF) systems at VHF and UHF such as, for example, in sectorless DF.

It is known, that a moderately directive, frequency-independent radiation pattern can be achieved with an electrically small L-shaped thin filament radiator, terminated in an end-loading resistor as shown and described in U.S. Pat. No. 3,605,097 assigned to the assignee of the present application. Such an end-loaded filament antenna is commonly referred to as ELFA.

As seen in U.S. Pat. No. 3,605,097, an ELFA embodies an electrically small filament. The filament may be comprised as two elongated wire sections with one section extending at an angle from a ground plane and the second section extending from the end of the first section parallel to the ground plane and terminated by a resistor coupled to the ground plane. Both sections lie generally in a plane normal to the ground plane and produce linearly polarized radiation in such plane with the radiation so produced predominating in a predetermined direction called the forward direction.

A weak characteristic of all ELFA's, however, is that good forward gain (i.e., the gain at the ground plane in the forward direction) and low back radiation are incompatible for these antennas.

While still used in a number of applications at VHF and UHF, because better antennas are simply not available, an ELFA with a reasonably good forward gain (i.e., a gain variation from 0 to −20 dB over two octaves) has approximately 8 to 12 dB back lobe, which can be detrimental to performance in certain applications.

SUMMARY OF INVENTION

In view of the foregoing, a principal object of the present invention is an improved broad-band, electrically small radiator of the ELFA type having negligible backlobe, a useful gain, and an improved directivity.

The basic antenna configuration comprises two stripline radiators. The radiators, each of which comprises a pair of angularly displaced planar sections, are printed on opposite sides of a single printed circuit board or on a single side of two printed circuit boards and are supported adjacent to a ground plane.

An important feature of the antenna of the present invention is that the individual radiators have different heights, and they "look" in opposite directions, such that their respective radiation pattern peaks are 180° apart at the ground plane.

The remaining structure consists of a feed network located under the ground plane, which is comprised of one 180° directional coupler and two phasing cables, which provide appropriate excitation to the individual antennas for backlobe cancelation. As opposed to a wire or filament type, the stripline type of ELFA is found to constitute an improvement over the prior art in itself, because it results in a better antenna impedance, smaller cross section (about 1/32 inch width) and a better mechanical structure.

DESCRIPTION OF FIGURES

The above and other objects, features and advantages of the present invention will become apparent from the following detailed description of the accompanying drawings in which.

DETAILED DESCRIPTION

As previously indicated, a limitation of conventional ELFA's is that forward gain and low back radiation are incompatible for these antennas. This can be demonstrated by means of a few simple equations.

Figure 1:
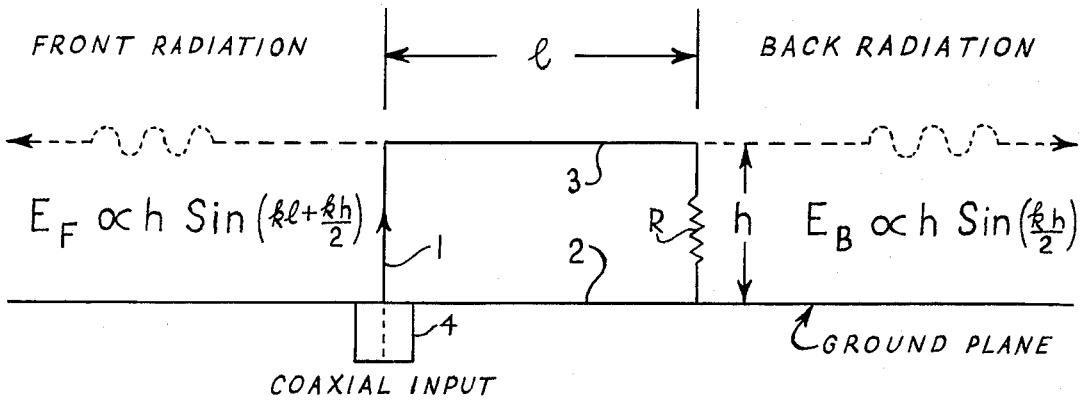
FIG. 1 PRIOR ART
FIG. 1 is a schematic representation of a prior art ELFA.

Referring to FIG. 1, there is shown schematically a conventional ELFA radiator comprising a short filamentary wire section 1 having a height $h$ extending vertically from a ground plane 2. Extending horizontally from the top of section 1 is a second, longer filamentary wire section 3 of length $l$. Coupled between the free end of section 3 and the ground plane is a resistor R. At the lower end of section 1 there is provided a coaxial cable coupler 4. Coupler 4 is provided for coupling the lower end of section 1 to the center conductor of a coaxial cable and the ground plane to the outer conductor of the cable.

When coupled to a source of energy, the electric fields, radiated in the front ($E_F$) and back ($E_B$) directions from the antenna of FIG. 1, can be approximately expressed by $$E_F \propto h\mathrm{Sin}\left(kl + \frac{kh}{2}\right) \quad (1)$$

$$E_B \propto h\mathrm{Sin}\left(\frac{kh}{2}\right) \quad (2)$$

where $k = (2\pi)/\lambda$ is the usually assumed free space propagation constant along the wire, and $\lambda$ is the operating wavelength. These fields are radiated by the vertical members of the antenna and their intensity is directly proportional to the height $h$ of these vertical members.

Since the gain, $G$, is a measure of power concentration or power density in a given direction, it is proportional to the square of the height, or $$G \propto h^2 \quad (3)$$

Having established the dependency of gain on the antenna height, $h$, let us examine the expression for the front-to-back ratio, $F/B$, which can be obtained by dividing equation (1) by the equation (2):

$$\frac{F}{B} = \frac{E_F}{E_B} \frac{\sin\left(kl + \frac{kh}{2}\right)}{\sin\left(\frac{kh}{2}\right)} \tag{4}$$

For electrically small antennas the sines in the equation (4) can be replaced by their arguments, yielding the following approximation to the front-to-back ratio:

$$\frac{F}{B} \simeq 1 + \frac{2l}{h} \tag{5}$$

The term, $(2l)/h$, in equation (5) is usually the dominant one; hence, the front-to-back ratio on the power basis is then inversely proportional to the square of the height, $h$, i.e., $$\frac{F_p}{B_p} \propto \frac{1}{h^2} \tag{6}$$

where $F_p$ = forward radiated power, $B_p$ = back radiated power.

These conditions (3) and (6) clearly indicate that good gain and low backlobe are incompatible. As an example, to reduce the backlobe by 10 dB causes a sacrifice of 10 dB in the antenna gain.

There is another restriction that must be kept in mind: In a practical design the parameter $(h + l)$ of the antenna is fixed. It is, usually, chosen not to exceed approximately a quarter wavelength ($\lambda/4$) at the highest frequency of operation. Hence, any attempt to reduce the backlobe by increasing the $l/h$ ratio will result in smaller $h$ and hence, in lower gain.

By means of the present invention, however, backlobe radiation is essentially eliminated without a significant sacrifice in gain.

Figure 2:
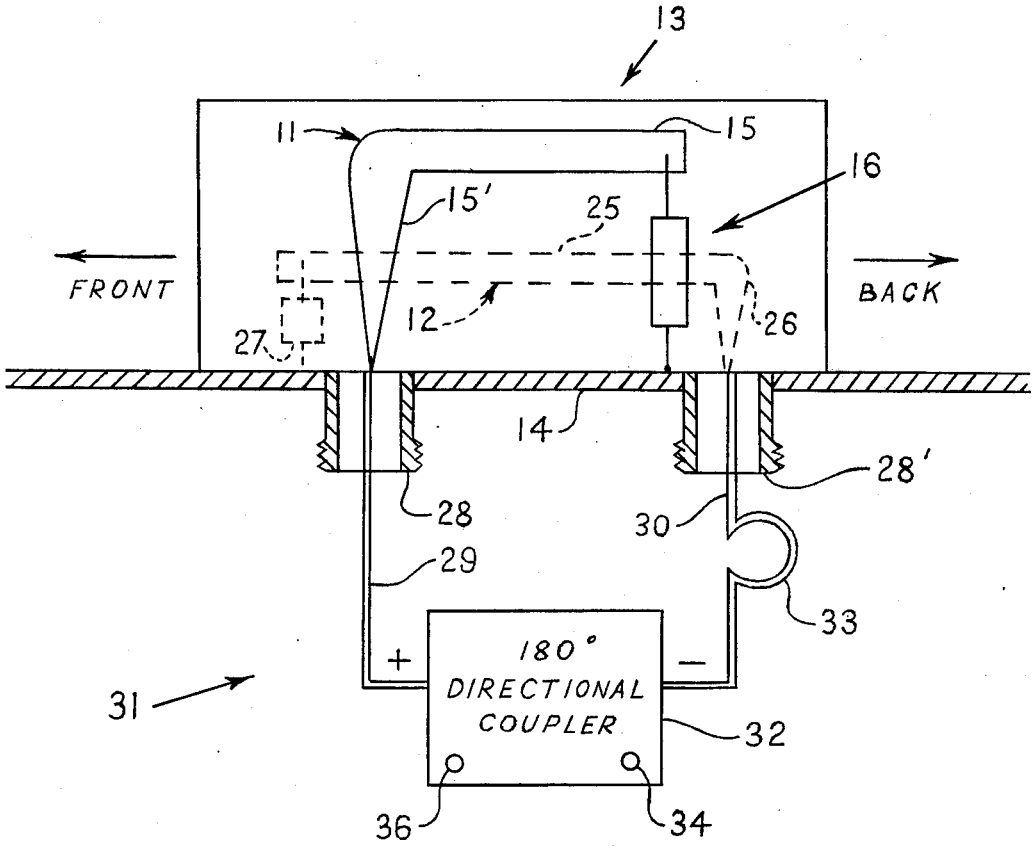
FIG. 2 is a diagrammatic view of an antenna according to the present invention.

Referring now to FIG. 2, there will be seen to be provided in accordance with the present invention, a pair of stripline antennas or radiators 11 and 12. Radiators 11 and 12 are supported on a substrate 13 adjacent to a ground plane 14. Substrate 13 is typically a conventional printed circuit board having a pair of parallel planar surfaces and a typical thickness in the range of 0.02 to 0.031 inches. The radiators 11 and 12 are essentially planar metallic members which are printed on opposite sides of the substrate 13 as by conventional photoetching techniques. They may, of course, by made separately and fixed to substrate 13 in any suitable manner. Alternatively, each of the radiators may be placed or printed on the surface of separate adjacent substrates spaced, for example, a fraction of an inch apart, as of 3/32 inch, and supported adjacent to the ground plane. However, within reasonable limits, the spacing does not appear to be critical. With respect to the ground plane, the radiators 11 and 12 and substrate 13 are supported preferably in a plane substantially normal to the ground plane.

Each of the radiators 11 and 12 includes a pair of elongated planar sections. Radiator 11 on the front side of substrate 13, as shown in full lines in FIG. 2, comprises a planar section 15 which extends parallel to the ground plane 14 and is terminated at one end by a resistor 16 coupled to the ground plane 14. Extending from the opposite end of section 15 is a second planar section 15' which extends at an angle therefrom toward the ground plane. Section 15' is preferably of a generally triangular shape with the apex thereof directed toward the ground plane. Similarly, radiator 12 on the rear surface of substrate 13, as shown in broken lines in FIG. 2, comprises a first planar section 25 which extends parallel to the ground plane 14 and is terminated at one end by a resistor 27 coupled between the section 25 and the ground plane 14. Extending from the opposite end of section 25 is a second planar section 26. Like section 15', section 26 extends from the end of section 25 at an angle therefrom toward the ground plane. Also like section 15', section 26 is preferably of a generally triangular shape with the apex thereof directed toward the ground plane. Preferably the angle which sections 15' and 26 make with sections 15 and 25, respectively, is 90°.

An electrical coupling to radiators 11 and 12 is provided by a pair of coaxial cable couplers 28 and 28' extending through the ground plane 14 for coupling the apex of sections 15' and 26 to the center conductors of a pair of coaxial cables 29 and 30 and the outer shield or conductor of the cables to the ground plane. In FIG. 2 the outer conductor of coaxial cables 29 and 30 are omitted for clarity.

The radiators 11 and 12 are energized by a feed network 31 disposed on the opposite side of the ground plane 14 from the radiators. This feed network, which is only schematically illustrated in FIG. 2, includes a 180° directional coupler 32 having one cable 29 connected to one terminal thereof and the other cable 30 coupled to another terminal by an adjustable delay line 33. The coupler 32, which may be conventional, also has an input terminal 34 and a load terminal 36. Power applied to input terminal 34 is applied in 180° phase relation to cables 29 and 30 which may be also employed as phasing cables for fine phase adjustment.

Figures 4A, 4B:
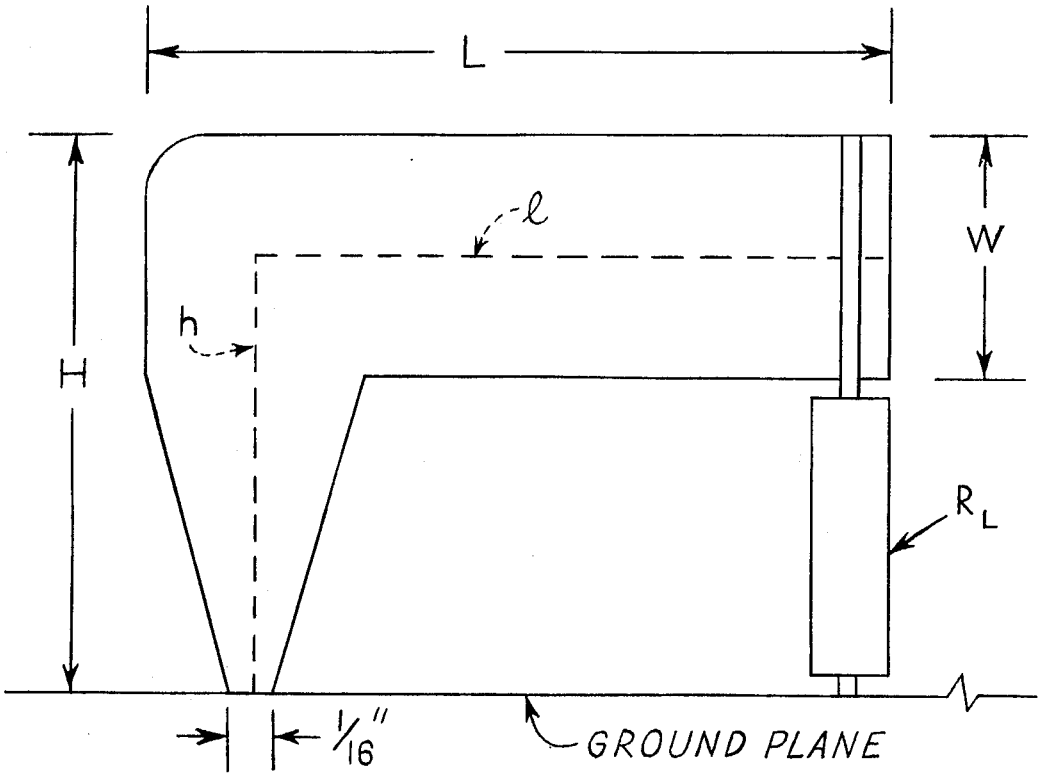
FIGS. 4A and 4B illustrate typical dimensions of the radiators of FIG. 2 in wavelengths at center frequency.

Referring to FIGS. 4A and 4B, there is shown typical dimensions of the radiators 11 and 12 in wavelengths at center frequency wherein:

- $L$ represents the overall lengths of sections 15 and 25 for the tall and short elements, respectively;
- $l$ represents the median length of sections 15 and 25 to the center line of sections 15' and 26, respectively;
- $H$ represents the overall length or height above the ground plane of sections 15' and 26;
- $h$ represents the median length of sections 15' and 26 to the center line of sections 15 and 25;
- $W$ represents the width of sections 15 and 26;
- $R_L$ is the load resistor; and wherein the apex of sections 15' and 26 at the level of the ground plane is approximately 1/16 inch.

Figure 3A:
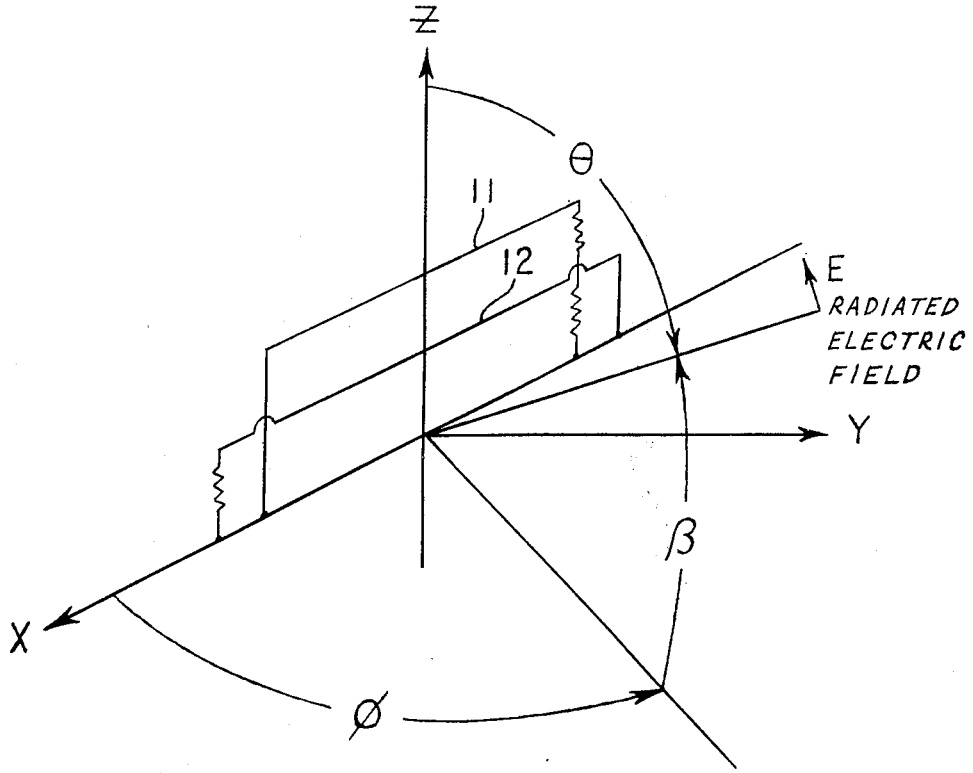
FIGS. 3A and 3B are pictorial representations, respectively, of an antenna and resulting field which illustrate the principal of backlobe cancellation with the present invention.
Figure 3B:
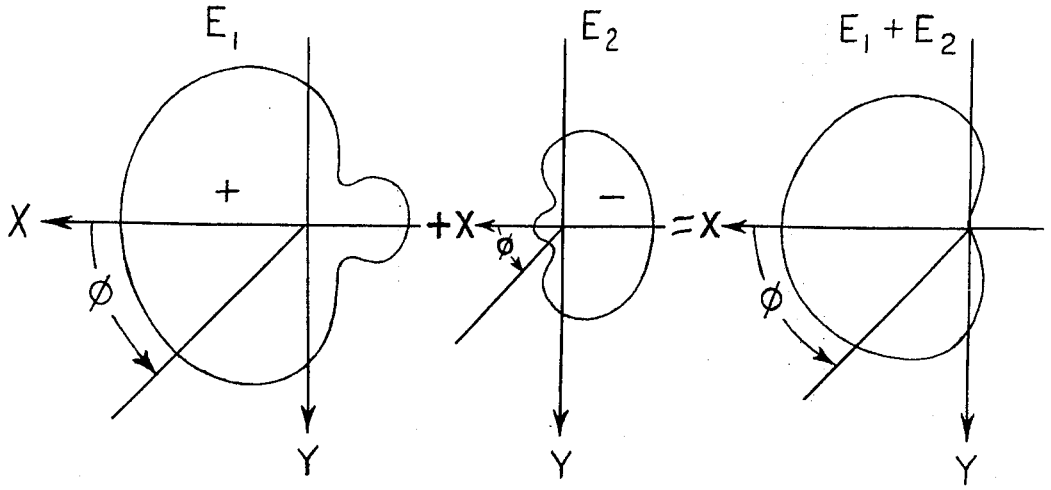

Referring to FIGS. 3A and 3B, the principle of backlobe cancellation is illustrated pictorially. In FIG. 3A the radiators 11 and 12 are shown as wire antennas, detached from the coupler 30 for simplicity, located at the origin of a spherical coordinate system. The principal planes of radiation are the XZ—the E-plane, and the XY—the H-plane. Without a loss of generality the principle of backlobe cancellation is illustrated in the H-plane in FIG. 3B.

The antenna 11 is the dominant antenna whose beam peak points along the positive X-axis. By virtue of the greater height, antenna 11 has a larger gain than the antenna 12 but it also has a disturbingly high backlobe. The beam peak of the antenna 12 points in the negative X-direction and is thus coincident with the backlobe position of the antenna 11. By adjusting the height of the antenna 12 and/or the power split of the coupler 32, the amplitudes of the electric fields radiated by the two antennas in the rear direction can be made equal. The coupler 32 and the phasing cables (used for fine phase adjustment) provide a frequency-independent 180° phase relationship between the two antenna fields which cause their subtraction. As a result, the backlobe vanishes and the radiation pattern becomes more directive, as clearly shown in FIG. 3B.

The gain of the antenna of this invention may be made substantially the same as that of a conventional ELFA. It may be expected, intuitively, that the resultant gain of the low backlobe antenna configuration hereof will be, in general, somewhat lower than the gain of the larger antenna element 11 alone because of the power division at the 180° coupler. The amount of gain reduction is in fact dependent on the type of coupler employed.

The worst case occurs with a 3 dB coupler (i.e., with an equal power split), which will result in a nominal 3 dB loss in gain. Some of this loss (1 or 1.5 dB) is recovered, however, due to increased directivity of the radiation pattern. The use of higher coupling values (e.g., 10 dB coupler) results in full gain recovery while yet maintaining low back radiation.

Although a preferred embodiment of the present invention is described herein, it is intended that the embodiment described be considered only as illustrative of the invention and not as defining the scope thereof. In addition to placing the radiators 11 and 12 on either one or two substrates, other modifications or changes to the embodiment described will undoubtedly occur to those skilled in the art upon reading this disclosure and thus the invention is not to be limited to the details of illustration nor particular terms of description.

What is claimed is:

1. An antenna comprising;

means for providing a ground plane;

a first and a second planar metallic radiator of substantially different sizes, with each radiator having a first elongated planar section extending parallel to said ground plane and a second elongated planar section extending from one end of said first planar section and at an angle therefrom toward said ground plane;

means for supporting said planar radiators adjacent to said ground plane;

means for providing an electrical impedance coupled between the opposite ends of each of said first sections and said ground plane; and coupling means connected to the second sections of each of said radiators adjacent to said ground plane for energizing said radiators to radiate a directional beam therefrom.

2. An antenna according to claim 1 further defined by said coupling means comprising means for coupling said second elongated sections of each of said planar members to the center conductor of a first and a second coaxial cable and the outer conductor of said coaxial cables to said ground plane.

3. An antenna according to claim 1 further defined by said planar radiators being supported adjacent each other in parallel planes and being disposed in opposite directions with the second section of the first radiator adjacent the impedance coupled to the second radiator.

4. An antenna according to claim 1 wherein each of said second elongated sections of each of said planar radiators is triangularly shaped.

5. An antenna according to claim 4 further defined by said coupling means coupling a source of energy to the apex of each of said triangularly shaped second elongated planar sections.

6. An antenna according to claim 1 wherein said coupling means comprises directional coupling means for coupling energy of a predetermined different phase to each of said planar radiators.

7. An antenna according to claim 6 wherein said predetermined phase is substantially 180° for radiating directive low backlobe electromagnetic radiation from said planar members.

8. An antenna according to claim 1 wherein said radiators comprise thin metallic strips disposed upon a single planar dielectric substrate having a first and a second planar surface for carrying said first and said second planar radiators, respectively.

9. An antenna according to claim 1 wherein said means for supporting said radiators comprises:

a first and a second planar dielectric substrate, each of said substrates having a planar surface for carrying said first and said second planar radiators, respectively; and means for supporting each of said planar substrates in spaced apart relationship whereby said planar radiators are located in parallel planes substantially normal to said ground plane.

10. An antenna comprising:

means for providing a ground plane;

a first radiating means for radiating electromagnetic energy predominantly in a first direction having a first planar section extending in parallel to said ground plane which is terminated at one end by a resistor coupled to said ground plane and at its opposite end by a second planar section which extends toward said ground plane; and a second radiating means for radiating electromagnetic energy predominantly in a direction opposite from said first radiating means, having a first planar section extending in parallel to said ground plane which is terminated at one end by a resistor coupled to said ground plane and at its opposite end by a second planar section which extends toward said ground plane.

11. An antenna according to claim 10 further comprising: means for coupling electrical energy to said first and said second radiating means having a predetermined phase relationship.

12. An antenna according to claim 11 wherein said predetermined phase relationship is approximately 180°.

13. An electrically small, directive, low backlobe antenna comprising means defining a planar ground plane, a first electrically short planar radiator disposed in a plane substantially perpendicular to said ground plane and having an elongated top section substantially parallel to said ground plane and a second section connected to said first section extending at an angle therefrom at a front end of said first radiator and top section thereof towards said ground plane, a first impedance connecting the rear end of said top section to said ground plane, a second electrically short planar radiator of a different size than said first radiator disposed adjacent said first radiator in a plane substantially perpendicular to said ground plane and parallel to the plane of said first radiator and having an elongated top section substantially parallel to said ground plane and a second section connected to said top section and extending at an angle therefrom at a front end of said second radiator and top section thereof towards said ground plane, a second impedance connecting the rear end of the top section of said second radiator to said ground plane, said radiators being oppositely disposed with the front end of said first radiator adjacent the rear end of said second radiator, and coupling means connected to said ground plane and to the second sections of said first and second radiators for energizing said radiators with electrical power that is 180° out of phase between said radiators whereby said antenna radiates a directive beam pattern with a very small backlobe.

14. The antenna of claim 13 further defined by a single, thin, planar dielectric plate mounted perpendicularly to said ground plane and having said radiators disposed one on each flat side thereof in close proximity to each other, said radiators having a length of the top sections thereof of the order of 0.1 wavelength of centered frequency of antenna operation, said first radiator having a height of the second section thereof of the order of twice the height of the second section of the second radiator and the height of each section being less than 0.1 wavelength at center operating frequency of antenna operation.

15. The antenna of claim 13 further defined by said coupling means including a pair of coaxial cables extending through said ground plane with each having the outer conductor thereof connected to said ground plane and the center conductor of said cables being separately connected to the ends of second sections of said radiators adjacent said ground plane.

* * * * *